US006371249B1

(12) United States Patent
Schöps et al.

(10) Patent No.: US 6,371,249 B1
(45) Date of Patent: Apr. 16, 2002

(54) QUICK CONNECTOR APPARATUS FOR ELEVATOR GUIDE RAIL SECTION

(75) Inventors: Karl-Friedrich Schöps; Klaus Murawski, both of Berlin (DE)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/586,015

(22) Filed: Jun. 2, 2000

(51) Int. Cl.[7] ..... B66B 7/02
(52) U.S. Cl. ..... 187/408; 52/30
(58) Field of Search ..... 187/406, 408; 104/127, 129; 52/30; 238/338–348

(56) References Cited

U.S. PATENT DOCUMENTS 1,505,345 A * 8/1924 Heptner
1,925,867 A * 9/1933 Dunlop ..... 187/95
3,420,337 A * 1/1969 Magee ..... 187/95
3,601,938 A * 8/1971 Loomis ..... 52/30
3,799,437 A * 3/1974 Scherbaum ..... 238/239
4,577,729 A * 3/1986 Karol ..... 187/95
4,593,794 A * 6/1986 Russeau ..... 187/95

* cited by examiner

*Primary Examiner*—Thomas J. Brahan
(74) *Attorney, Agent, or Firm*—Wall, Marjama & Bilinski, LLP

(57) ABSTRACT

Apparatus for mounting T-shaped sections of a guide rail network of an elevator system within a hoistway. Spaced apart horizontal brackets are attached to a wall of the hoistway and the base of a guide rail section is seated against two spaced apart brackets. Threaded fasteners are mounted in each bracket on either side of the base and a quick acting connector is threaded onto each fastener. Each connector includes a locking arm that can be moved over the base of the rail section and brought into contact therewith as it is rotated about the fastener. A lever arm is attached to each locking arm which provides sufficient mechanical advantage to force the rail section into locking contact with the brackets.

5 Claims, 2 Drawing Sheets

QUICK CONNECTOR APPARATUS FOR ELEVATOR GUIDE RAIL SECTION

FIELD OF THE INVENTION

This invention relates generally to elevators, and specifically to mounting and aligning guide rails within an elevator hoistway for guiding the elevator cab and counterweights along a vertical path of travel.

BACKGROUND OF THE INVENTION

In most buildings over five stories high, the elevator cabs and counterweights are raised and lowered within a hoistway by ropes that pass over drive sheaves and pulleys. The cab and the counterweight unit are equipped with roller assemblies that are arranged to ride along vertical guide rails positioned on both sides of the cab and counterweight unit. The guide rails are typically made up of sections that are cojoined in vertical alignment within the hoistway.

Each guide rail section typically is a T-shaped member that has a base and a web that is centrally mounted upon the base and extends inwardly toward the cab or counterweight unit. The webs combine in assembly to form each of the vertical guide rail. As illustrated in the FIG. 1, each rail section 11 has heretofore been secured at each end by a pair of heavy clamps 14. One clamp in a pair is arranged to engage the base flange 13 of the rail section on one side of the web 15 while the other clamp in the pair is arranged to similarly engage the base on the opposite side of the web. Each clamp is secured by a bolt 17 to a bracket 16 that is attached to the wall of the hoistway. The bolt is passed through aligned clearance holes formed in the clamp and the bracket and is held in place by a nut 18 and a lockwasher 19. Each clamp contains an arm 20 that passes over the base of the rail section. Tightening the nut draws the arm tightly against the base section thus locking the base to the bracket.

The prior method of securing the individual guide rail sections in place, although very effective, requires the use of four bolts, four lockwashers and four nuts for each section. Accordingly, erecting each of the four required guide rails takes a good deal of time and effort and is therefor relatively costly.

SUMMARY OF THE INVENTION

It is therefore an object of the present invention to improve method and apparatus used in the installing and aligning the guide rails used in elevator systems.

It is a further object of the present invention to provide a quick acting clamp for securing elevator guide rails to supporting members.

A still further object of the present invention is to reduce the amount of time required to erect and maintain the rail guides of an elevator system.

Another object of the present invention is to simplify the installation and maintenance of guide rails employed in elevator systems.

These and other objects of the present invention are attained by method and apparatus for rapidly installing the rail sections of an elevator system within a hoistway or removing the section during periods of maintenance or the like. Quick acting clamps are positioned at the four comers of each T-shaped section and are arranged to engage the base flange of the section and lock the base flange to a support member. Threaded fasteners are mounted in the support member in pairs at the top and bottom locations for each section. The fasteners in each pair extend inwardly on each side of the section. A quick acting connector is threaded onto each fastener which includes a locking arm and a lever arm that are arranged to pivot about the fastener. The locking arm is initially brought into parallel alignment with the base flange at an elevation slightly above the base. Turning the arm in one direction upon the fastener causes the locking arm to pass over the base flange and at the same time the locking arm is lowered into contact with the base flange. The lever arm provides sufficient mechanical advantage to force the base flange into secure locking contact with the support member. The pitch of the threads on the fasteners are such that rotation of the connector about 90° completes the closing of the connector. The connectors can be rapidly opened in the event the sections must be removed or realigned during periods of maintenance.

BRIEF DESCRIPTION OF THE DRAWING

For a better understanding of the these and other objects of the present invention, reference should be made to the following detailed description of the invention which is to be in association with the accompanying drawings, wherein.

DETAILED DESCRIPTION OF THE INVENTION

Figure 4:
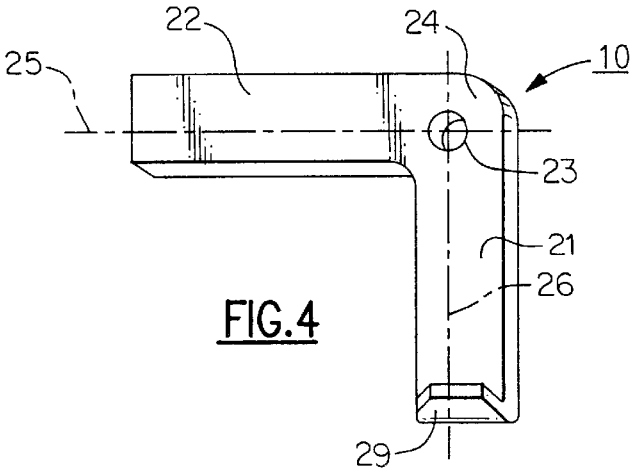
FIG. 4 is an enlarged perspective view illustrating the quick acting connector used in the practice of the present invention.

Turning initially to FIG. 4, there is illustrated a quick acting connector, generally referenced 10, that is employed in the practice of the present invention. The connector includes two arms, a locking arm 21 and a lever arm 22, that are integrally joined at their proximal ends. The lever arm is offset from the locking arm by an angle of about 90°. A tapped hole 23 is formed in the connector at the elbow 24 with the hole being centered at the intersection of the axes 25 and 26 of the two arms. A raised pad 29 extends across the distal end of the locking arm, the function of which will be explained in greater detail below. Preferably, the pad is formed by simply turning the distal end of the lever arm back at an angle of about 90°. The connector is preferably fabricated in one piece from a high strength metal such as steel.

Figure 1:
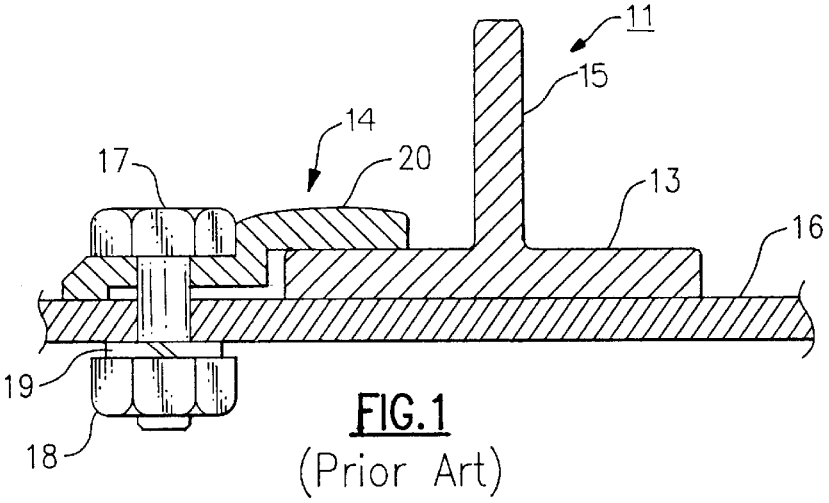
FIG.1 (Prior Art)
FIG. 1 is a sectional view looking down upon a clamp used in the prior art for installing guide rail sections of an elevator system in a hoistway.
Figure 3:
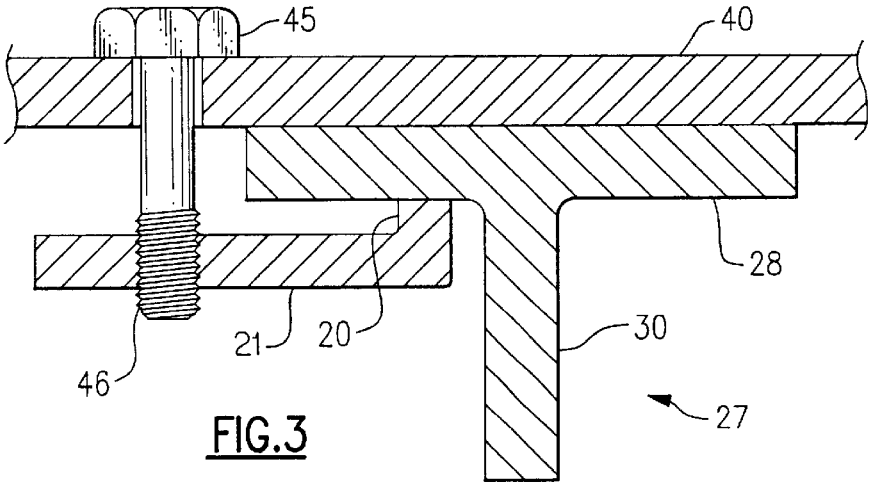
FIG. 3 is an enlarged partial sectional view looking down upon a quick acting connector used in the practice of the present invention illustrating the connector in a locked position against a guide rail section.
Figure 2:
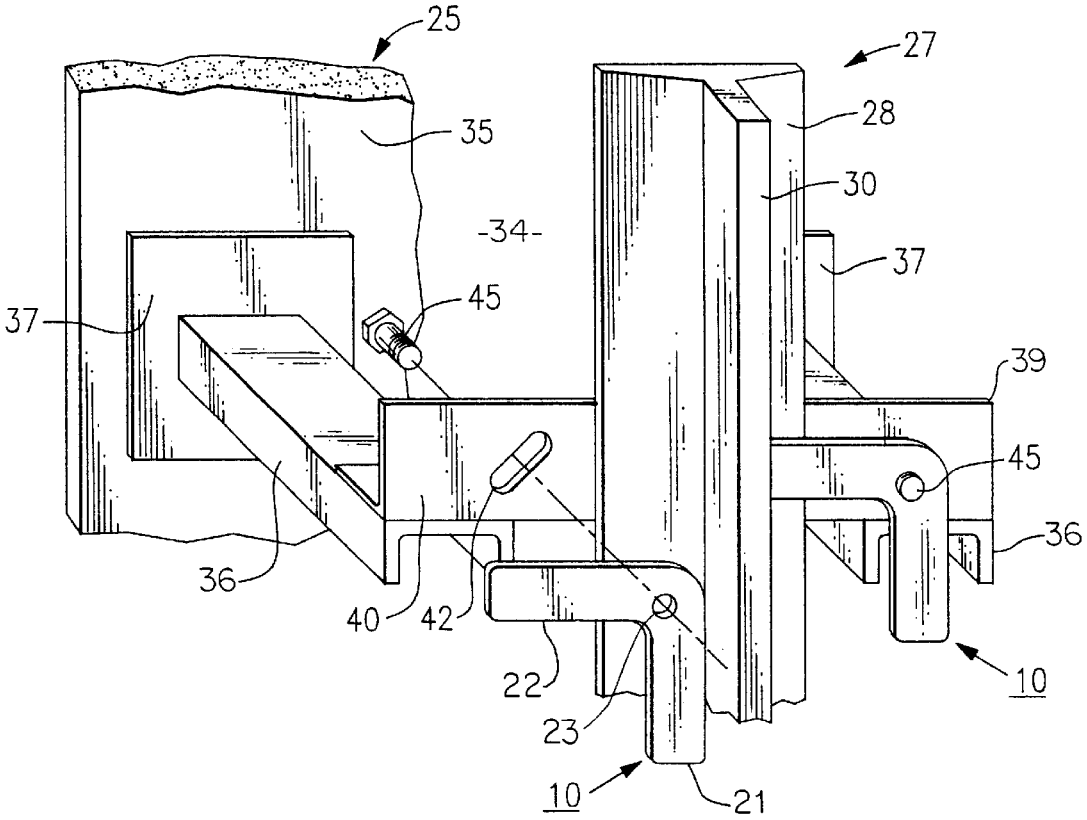
FIG. 2 is a partial perspective view of an elevator hoistway showing the quick acting clamp of the present invention securing a rail section in assembly.

Turning to FIGS. 2–4, a portion of a hoistway 34 is shown in FIG. 2 in which the guide rails of an elevator system are installed. As noted above, the guide rails are installed in pairs within the hoistway with the elevator cab typically riding between one pair of rails and the counterweights riding between a second pair of rails. Each rail, in turn, is constructed of a number of T-shaped sections 27 with the number of sections being determined by the height of the structure being serviced. The sections each contain a base 28 and a perpendicularly aligned web 30 that protrudes inwardly from the center of the base toward the cab or the counterweight unit. Although not shown, roller guides attached to the elevator cab and the counterweight unit are arranged to ride upon the rails.

A pair of spaced apart horizontal beams 36 are cantilevered from the wall 35 of the hoistway. The beams are connected as by welding to mounting plates 37 that are anchored in the hoistway wall by any suitable means. An angle iron 39 is mounted between the beams at the distal end thereof One leg 40 of the angle iron is vertically aligned within the hoistway and provides a surface against which the rail section are seated. In practice, two angle irons are utilized to support each section. One angle iron is located at the lower end of the section and a second angle iron is located at the upper end of the section. Only the upper angle iron and one connector is shown in FIG. 2.

The angle irons, which will hereinafter be referred to as brackets, contain slotted holes 42 formed in the vertical leg 40 of the bracket with the holes being located on either side of the base of the rail section. A bolt 45 is passed through the slotted hole and is of sufficient length so that the threaded tang of the bolt protrudes outwardly beyond the upper surface 28 of the rail section. Each slotted hole is turned at an angle of about 45° with regard to the vertical axis of the rail section and thus provide adequate adjustment for the bolt to be aligned in assembly. As shown in FIG. 3, the threaded end 46 of the bolt is mated with the tapped hole provided in the connector and initially the connector is moved downwardly to an open position as shown by the connector on the left hand side of the rail section in FIG. 2. When in the open position, the locking arm 21 of the connector is parallel with the web 30 and is adjacent to the base. The pad 29 at the distal end of the locking arm is, at this time, slightly elevated above the upper surface of the base.

The threaded pitch on the bolt is such that when the connector is turned about 90° into the closed position as illustrated by the connector on the right side of the rail section in FIG. 2, the pad 29 is brought into tight closure against the upper surface of the base flange of the rail section. As can be seen, the connector can be quickly set up in assembly to the desired open position and thereafter turned manually to the closed position using the lever arm. Sufficient mechanical advantage is gained through the lever arm to insure that the rail section is securely locked against the bracket at closure. Although only one connector is shown in FIG. 3, it should be clear that a second connector is similarly mounted on the opposite side of the web at the upper comer of the section. desired open position and thereafter turned manually to the closed position using the lever arm. Sufficient mechanical advantage is gained through the lever arm to insure that the rail section is securely locked against the bracket at closure. Although only one connector is shown in FIG. 3, it should be clear that a second connector is similarly mounted on the opposite side of the web at the upper corner of the section.

When in the closed position, the locking arm places a relatively high holding force on the bolt threads so that the connector will remain in place and not loosen under normal elevator operations. It should be further noted that once set up, the connectors can also be rapidly opened and reclosed when necessary during periods of maintenance or the like. It should be further evident that the present connector can be rapidly set up and locked in place without the use of tools or special fixtures. Although the threaded fasteners are shown herein mounted within slotted holes formed in the bracket, the fasteners may be studs that are either welded to the bracket or threaded into tapped holes provided in the bracket. The studs are prealigned prior to assembly.

While this invention has been explained with reference to the structure disclosed herein, it is not confined to the details set forth and this invention is intended to cover any modifications and changes as may come within the scope of the following claims:

What is claimed is:

1. Apparatus for securing an elevator guide rail within a hoistway that includes:

a T-shaped guide rail having a base flange containing an upper surface and a lower surface and a web centrally located upon the upper surface of said base flange, said rail being vertically disposed within the hoistway with the lower surface of the base flange facing one wall of the hoistway and the web extending perpendicularly from the upper surface of the base flange;

said lower surface of said base flange being seated in contact with a bracket secured to the hoistway;

at least one threaded fastener having a head and a threaded shank that passes through the bracket adjacent to one side of said base flange, said shank passing horizontally beyond the upper surface of said base flange;

a connector having a locking arm perpendicularly joined to a lever arm by an elbow, said at least one threaded fastener threadably engaging the connector at the elbow so that the locking arm is brought into clamping engagement with the upper surface of the base flange when the lever arm is turned in one direction and releasing said base flange when the lever arm is turned in an opposite direction.

2. The apparatus of claim 1 that includes a pair of threaded fasteners located on either side of the base flange, each threaded fastener being arranged to threadably engage a connector.

3. The apparatus of claim 2 wherein said bracket contains slotted holes through which the shank of each threaded fastener passes.

4. The apparatus of claim 1 wherein a raised pad is located on the distal end of said locking arm and is arranged to move into locking contact with the upper surface of said base flange when the connector is brought into clamping engagement with said base flange.

5. The apparatus of claim 1 wherein the lever arm is integrally joined to the locking arm of the connector.

* * * * *